US010573969B2

(12) United States Patent
Jang et al.

(10) Patent No.: US 10,573,969 B2
(45) Date of Patent: Feb. 25, 2020

(54) WIRELESS COMMUNICATION ANTENNA

(71) Applicant: WITS CO., Ltd., Yongin-si, Gyeonggi-do (KR)

(72) Inventors: Jae Hyuk Jang, Suwon-si (KR); Young Seung Roh, Suwon-si (KR); Hyun Jung Lee, Suwon-si (KR); Gie Hyoun Kweon, Suwon-si (KR); Jae Sun Won, Suwon-si (KR)

(73) Assignee: WITS Co., Ltd., Gyeonggi-do (KR)

( * ) Notice: Subject to any disclaimer, the term of this patent is extended or adjusted under 35 U.S.C. 154(b) by 191 days.

(21) Appl. No.: 15/784,302

(22) Filed: Oct. 16, 2017

(65) Prior Publication Data

US 2018/0219290 A1 Aug. 2, 2018

(30) Foreign Application Priority Data

Feb. 2, 2017 (KR) ..... 10-2017-0015035

(51) Int. Cl.

| | |
|---|---|
| ***H01Q 7/08*** | (2006.01) |
| ***H01Q 1/24*** | (2006.01) |
| *H01Q 1/22* | (2006.01) |

(52) U.S. Cl.

CPC ..... *H01Q 7/08* (2013.01); *H01Q 1/243* (2013.01); *H01Q 1/2225* (2013.01); *H01Q 1/242* (2013.01)

(58) Field of Classification Search

CPC ..... H01Q 7/08; H01Q 1/243; H01Q 1/2225; H01Q 1/242

See application file for complete search history.

(56) References Cited

U.S. PATENT DOCUMENTS

| | | | | |
|---|---|---|---|---|
| 2012/0176215 | A1* | 7/2012 | Kudo | H01F 27/34 336/221 |
| 2014/0239892 | A1 | 8/2014 | Sawa et al. | |
| 2015/0022410 | A1* | 1/2015 | Yamada | H01Q 7/06 343/788 |
| 2016/0171261 | A1* | 6/2016 | Alarcon Ramos | G06K 19/0717 340/10.1 |
| 2017/0176215 | A1* | 6/2017 | Yamagishi | G01D 5/145 |

FOREIGN PATENT DOCUMENTS

| | | | |
|---|---|---|---|
| EP | 2 278 661 | A1 | 1/2011 |
| JP | 5-183290 | A | 7/1993 |
| JP | 9-121094 | A | 5/1997 |
| KR | 10-1663839 | B1 | 10/2016 |
| WO | WO2013/069270 | A1 | 4/2015 |

* cited by examiner

*Primary Examiner* — Dameon E Levi
*Assistant Examiner* — David E Lotter
(74) *Attorney, Agent, or Firm* — Harness, Dickey & Pierce, P.L.C.

(57) ABSTRACT

A wireless communication antenna includes a solenoid coil portion including a core; and a magnetic body disposed in the core and comprising magnetic pieces arranged side by side in a direction perpendicular to or a direction parallel to a direction of a magnetic flux of the coil portion.

10 Claims, 7 Drawing Sheets

X - X`

WIRELESS COMMUNICATION ANTENNA

CROSS-REFERENCE TO RELATED APPLICATIONS

This application claims the benefit under 35 USC 119(a) of Korean Patent Application No. 10-2017-0015035 filed on Feb. 2, 2017 in the Korean Intellectual Property Office, the entire disclosure of which is incorporated herein by reference for all purposes.

BACKGROUND

1. Field

The following description relates to a wireless communication antenna used in a mobile device, or the like.

2. Description of Related Art

Wireless communications have been applied to be used in various environments. In detail, in connection with electronic payments, a coil type wireless communication antenna can be applied to various devices. With regard to electronic payments, a wireless communication antenna in the form of a coil may be applied to various devices. Recently, a wireless communication antenna in the form of a spiral coil attached to a cover, or the like, of a mobile device, has been employed in a mobile device.

In the case of such as wireless communication antenna used for an electronic payment, a solenoid coil structure in the form in which a coil is wound in a magnetic body is used. Due to an induced magnetic field generated when an electric field is applied, a change in a volume of a magnetic body may occur. In addition, due to such a change in a volume of a magnetic body, during an electronic payment, noise may occur.

SUMMARY

This Summary is provided to introduce a selection of concepts in a simplified form that are further described below in the Detailed Description. This Summary is not intended to identify key features or essential features of the claimed subject matter, nor is this Summary intended to be used as an aid in determining the scope of the claimed subject matter.

Examples provide a wireless communication antenna with reduced noise generation and a mobile device including the same.

In one general aspect, a wireless communication antenna includes: a solenoid coil portion including a core; and a magnetic body disposed in the core and including magnetic pieces arranged side by side in a direction perpendicular to or a direction parallel to a direction of a magnetic flux of the coil portion.

The pieces may be further be arranged side by side in the direction perpendicular to the direction of the magnetic flux of the coil portion, and each of the pieces may have a rod shape extended in the direction parallel to the direction of the magnetic flux.

A width of each of the pieces may be 0.5 mm to 5 mm.

The pieces may further be arranged side by side in the direction parallel to the direction of the magnetic flux of the coil portion.

The magnetic body may further include stacked magnetic layers.

The magnetic layers may be stacked in another direction perpendicular to the direction of magnetic flux of the coil portion.

Each of the magnetic layers may be divided into the pieces, and the pieces included in each of the magnetic layers may be arranged side by side in the direction parallel to the direction of the magnetic flux of the coil portion.

The magnetic layers may further include a first magnetic layer and a second magnetic layer adjacent to the first magnetic layer, and an interface between pieces of the first magnetic layer may be offset from an interface between pieces of the second magnetic layer.

A magnetostriction coefficient of the magnetic body may be 5 or more.

The coil portion may further include a first wiring portion disposed on a first surface of the magnetic body, a second wiring portion disposed on a second surface of the magnetic body, and conductive vias are configured to connect the first wiring portion to the second wiring portion.

Each of the first wiring portion and the second wiring portion may further include conductive patterns disposed on a thin film substrate.

The conductive vias may pass through a resin layer disposed in an outer edge of the magnetic body.

Other features and aspects will be apparent after an understanding of the following detailed description, drawings, and claims.

BRIEF DESCRIPTION OF THE DRAWINGS

FIG. 8 is a cross-sectional view taken long line I-I', FIG. 9 is a plan view, and FIG. 10 is a cross-sectional view taken long line X-X'.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
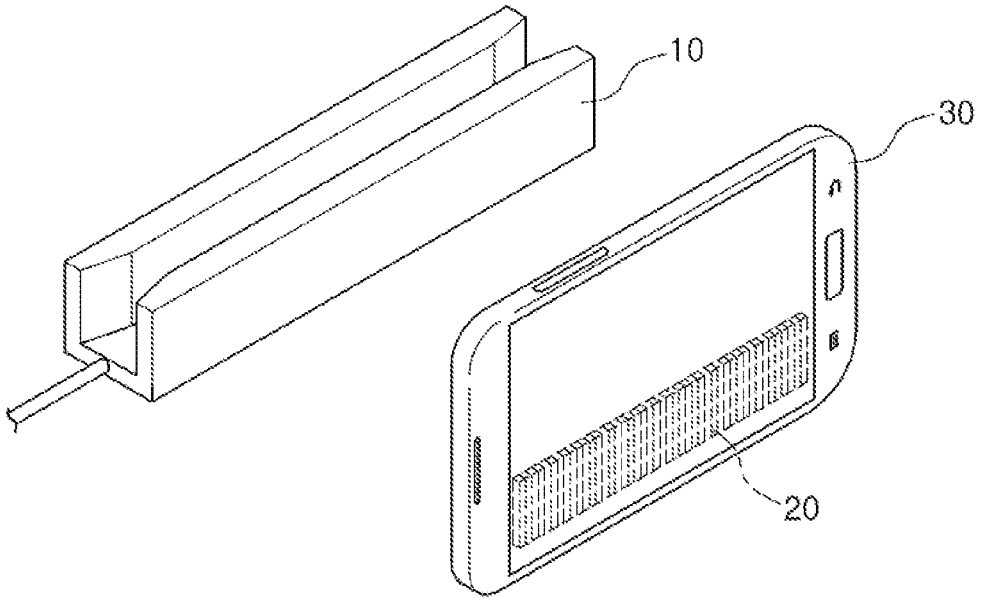
FIG. 1 is a perspective view illustrating an example in which a mobile device according to an example performs wireless communications.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof. In addition, the use of the term "may" herein with respect to an example or embodiment, e.g., as to what an example or embodiment may include or implement, means that at least one example or embodiment exists where such a feature is included or implemented while all examples and embodiments are not limited thereto.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Subsequently, examples are described in further detail with reference to the accompanying drawings.

FIG. 1 is a perspective view illustrating an example in which a mobile device according to an example performs wireless communications. In FIG. 1 a magnetic card reader 10 is a wireless signal receiving device having a receiving coil. According to an example, in addition to the magnetic card reader 10, various wireless signal receiving devices may be used as a device having a receiving coil.

A wireless communication antenna 20 is applied to a mobile device 30. The wireless communication antenna 20 may form a magnetic field according to the control of the mobile device 30. In addition, the wireless communication antenna 20 may be operated as a transmitting coil to wirelessly transmit information, and the wireless communication antenna 20 is magnetically coupled to a wireless signal receiving device having a receiving coil, e.g., the magnetic card reader 10.

In an example, the wireless communication antenna 20 changes a direction of a magnetic field, so that data to be transmitted to the magnetic card reader 10—for example, card number data—may be transmitted. In other words, the magnetic card reader 10 may generate the card number data using a change in a voltage across terminals of a receiving coil, caused by a change in a direction of a magnetic field formed in the wireless communication antenna 20.

Hereinafter, referring to FIGS. 2 and 3, magnetic coupling of a wireless communication antenna and a magnetic card reader and an operation of the magnetic card reader will be described in more detail.

Figure 2:
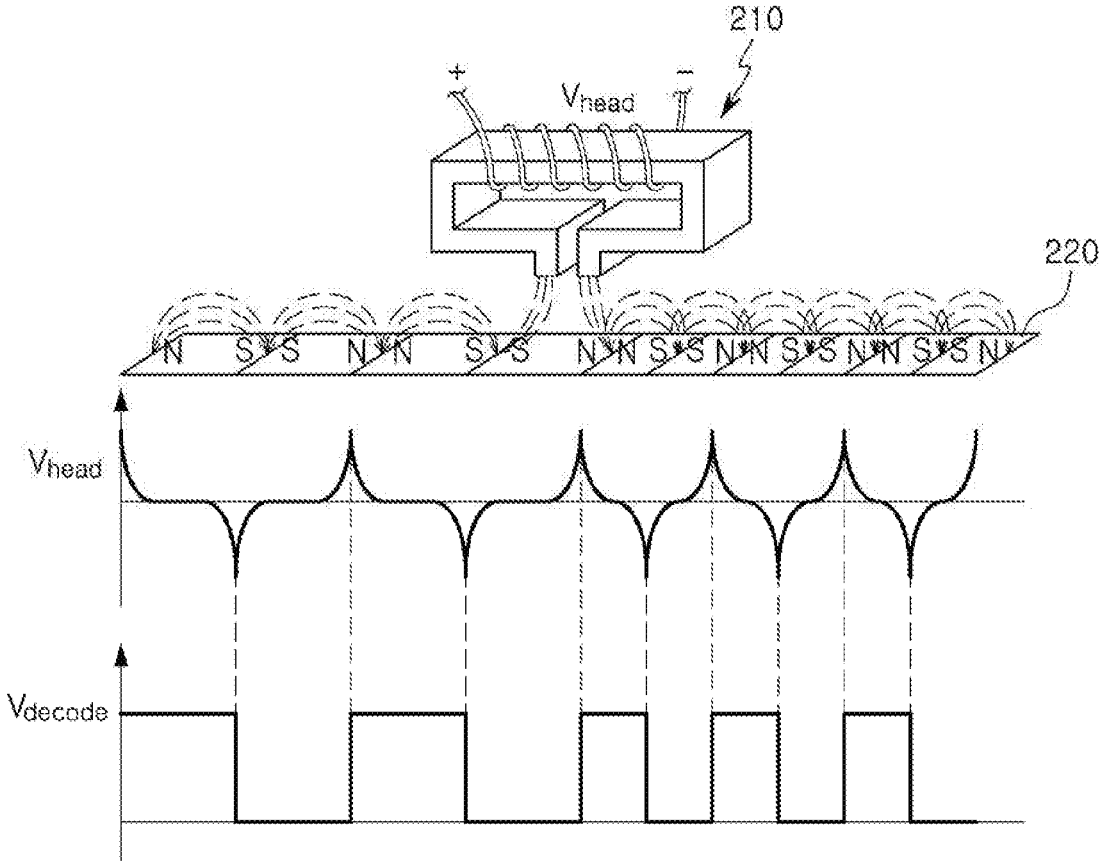
FIG. 2 is a view illustrating a voltage across terminals of a magnetic head adjacent to a magnetic card.

FIG. 2 is a view illustrating a voltage across terminals of a magnetic head adjacent to a magnetic card. The magnetic card is, e.g., a credit card or any other type of swipe card.

A magnetic card reader (10 of FIG. 1) includes a magnetic head 210 and an analog-to-digital converter (not shown). The magnetic head 210 may generate a voltage by magnetic flux. In other words, the magnetic head 210 may include a receiving coil, and may detect a voltage across terminals Vhead generated in both terminals of the receiving coil by a magnetic field.

When a receiving coil is present in a magnetic field, the voltage across terminals Vhead is induced by magnetic flux in the receiving coil. The voltage across terminals Vhead, having been induced, is provided to an analog-to-digital converter, and the analog-to-digital converter may generate a decoded signal Vdecode from the voltage across terminals. The decoded signal Vdecode may be a digital voltage signal, and may generate card information data from the decoded signal Vdecode.

In the magnetic card, a magnetic strip 220, which is magnetized, is present. As the magnetic head 210 moves above the magnetic strip 220, the voltage across terminals Vhead is induced by magnetic flux in the receiving coil of the magnetic head 210. The voltage across terminals Vhead may have a peak voltage according to a polarity of the magnetic strip 220. For example, when the same polarities are adjacent to each other, a peak voltage may be induced in the voltage across terminals Vhead. In addition, the analog-to-digital converter may generate the decoded signal Vdecode from the voltage across terminals Vhead. For example, the analog-to-digital converter generates an edge when a peak voltage is detected, and thus generates the decoded signal Vdecode.

The decoded signal Vdecode is a digital voltage signal, so digital data is decoded therefrom. For example, according to a length of a cycle of the decoded signal Vdecode, '1' or '0' may be decoded. According to an example illustrated in FIG. 2, a length of each of a first cycle and a second cycle of the decoded signal Vdecode is twice that of a third cycle. Thus, the first cycle and the second cycle of the decoded signal Vdecode are decoded to '1', and the third cycle through a fifth cycle may be decoded to '0'. A decoding method described above is illustrated by way of example, and various decoding techniques may be applied.

In FIG. 2, an example in which a magnetic card reader performs decoding from a magnetic strip is illustrated. Meanwhile, the magnetic head 210 generates a voltage across terminals not only from a magnetic strip, but also from a magnetic field generated from a wireless communication antenna. In other words, the magnetic head 210 of the magnetic card reader is magnetically coupled to a transmitting coil of a wireless communication antenna, and thus receives data, for example, card number data.

Figure 3:
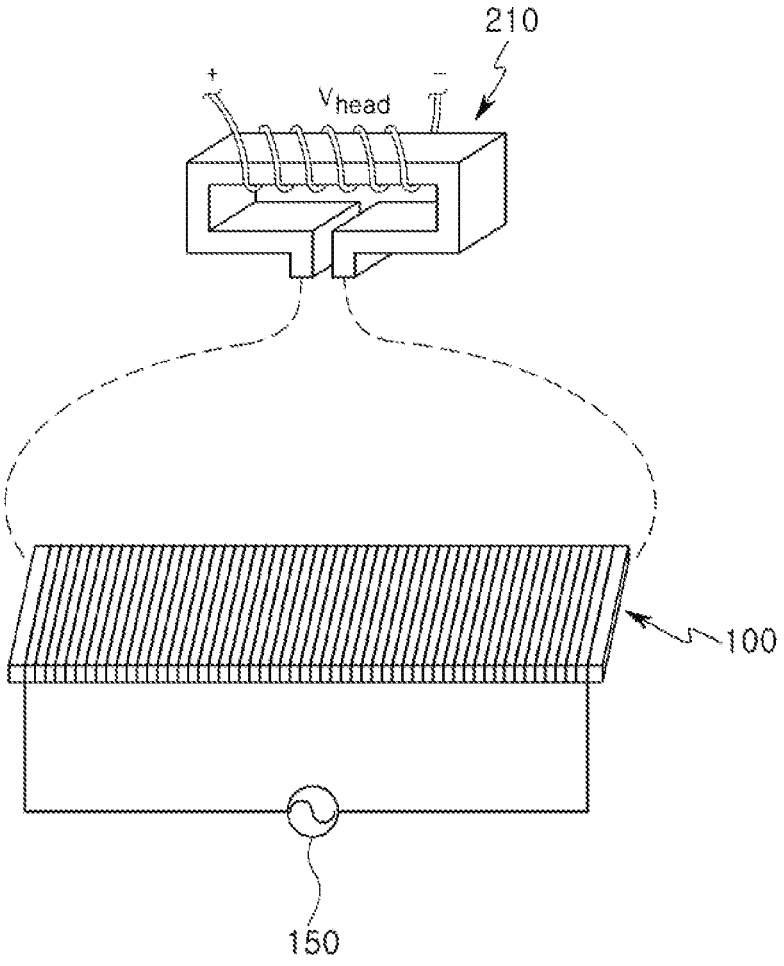
FIG. 3 is a view illustrating an example in which a magnetic head of a magnetic card reader is magnetically coupled to a wireless communication antenna according to an example.

FIG. 3 is a view illustrating an example in which a magnetic head of a magnetic card reader is magnetically coupled to a wireless communication antenna according to an example. A wireless communication antenna 100 receives a driving signal from a driving signal generator 150, thereby forming a magnetic field. The magnetic head 210 is magnetically coupled to the magnetic field formed by a transmitting coil, thereby receiving data.

Figure 4:
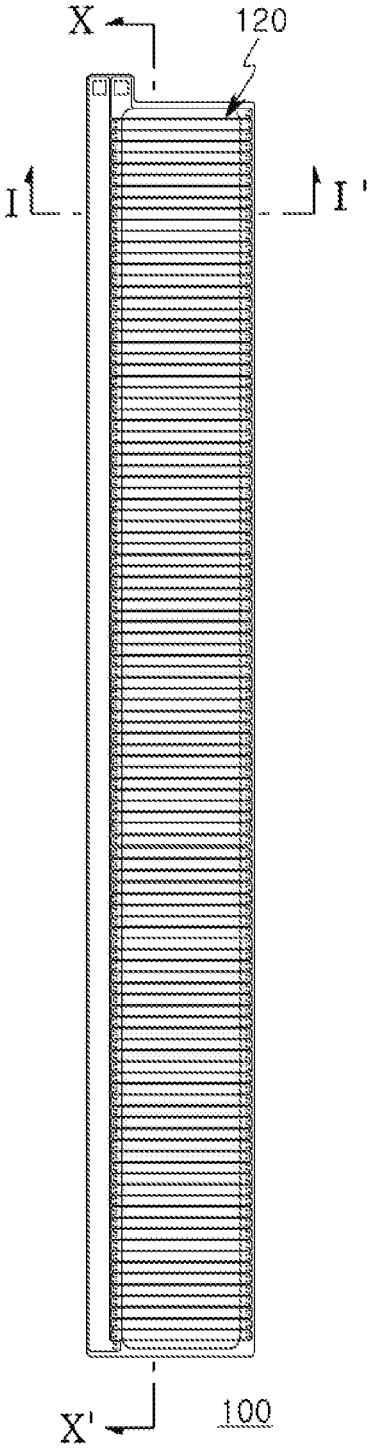
FIG. 4 is a plan view of a wireless communication antenna according to an example.
Figure 5:
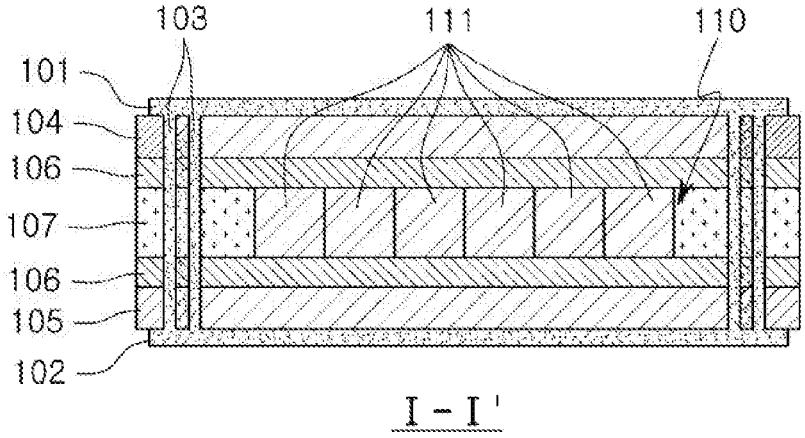
FIG. 5 is a schematic cross-sectional view of the wireless communication antenna of the example of FIG. 4.

Hereinafter, a specific form of a wireless communication antenna employed in an example will be described. FIG. 4 is a plan view of a wireless communication antenna according to an example. FIG. 5 is an example of a schematic cross-sectional view of the wireless communication antenna of the example of FIG. 4 taken along line I-I'.

Referring to FIGS. 4 and 5, the wireless communication antenna 100 according to an example includes a magnetic body 110 and a coil portion 120 in the form of a solenoid having the magnetic body 110 as a core. The magnetic body 110 is divided into a plurality of pieces 111, and the plurality of pieces 111 are arranged side by side in a direction perpendicular to or parallel to a direction of magnetic flux (a vertical direction based on FIG. 4) of the coil portion 120. In an example, the plurality of pieces are arranged side by side in a direction (a horizontal direction based on FIG. 4) perpendicular to a direction of magnetic flux. Here, the direction of magnetic flux corresponds to a direction in which a coil pattern of the coil portion 120 is wound as a result of winding or construction thereof. An interface between two pieces 111 is, e.g., a discontinuous surface.

The magnetic body 110, as a core of the coil portion 120, prevents an eddy current, and strengthens a magnetic field formed by the coil portion. The magnetic body 110 may be formed of a material having high magnetic permeability, for example, an amorphous alloy, a nanocrystalline alloy, ferrite, or the like. In this case, the amorphous alloy may be a Fe-based or Co-based magnetic alloy. The Fe-based magnetic alloy may be a material containing Si, for example, a Fe—Si—B alloy. As the content of a metal including Fe is increased, saturation flux density is also increased. However, when the content of a Fe element is excessive, formation of an amorphous alloy may be limited. Thus, the content of Fe may be 70 atomic % to 90 atomic %. In terms of amorphous formability, it is most preferable that the sum of Si and B is in the range of 10 atomic % to 30 atomic %. In order to prevent corrosion, a corrosion resistance element such as Cr, Co, or the like is added to a basic composition described above in a range of 20 atomic % or less. In order to impart different properties, as required, a small amount of a different metal element may be contained.

In addition, when the magnetic body 110 is implemented using a nanocrystalline alloy, the nanocrystalline alloy may be, for example, a Fe-based nanocrystalline magnetic alloy. The Fe-based nanocrystalline alloy may be a Fe—Si—B—Cu—Nb alloy. In this case, in order to form the nanocrystalline alloy, an amorphous metal ribbon may be heat-treated at an appropriate temperature.

In addition, when ferrite is used as the magnetic body 110, the ferrite may be Mn—Zn-based, Mn—Ni-based, Ba, Sr-based ferrite, or the like.

Referring to FIG. 5, the coil portion 120 will be described. The coil portion 120 includes a first wiring portion 101, a second wiring portion 102, and a plurality of conductive vias 103. In addition, a first substrate 104 and a second substrate 105 may be included, and the magnetic body 110 may be disposed between the first substrate 104 and the second substrate 105.

The first wiring portion 101 and the second wiring portion 102 are formed of a conductive pattern. In addition, the first wiring portion 101 is formed in or on the first substrate 104, and the second wiring portion 102 is formed in or on the second substrate 105. In addition, the plurality of conductive vias 103 allows conductive patterns of the first wiring portion 101 and the second wiring portion 102 to be connected to each other in a peripheral region of the magnetic body 110. In other words, in the wireless communication antenna 100, a solenoid formed by the first wiring portion 101, the second wiring portion 102, and the plurality of conductive vias 103 has the magnetic body 110 as a core.

The first substrate 104 and the second substrate 105 are a thin film substrate, for example, a flexible substrate such as a flexible printed circuit board (FPCB), but an example is not limited thereto. Meanwhile, the first substrate 104 or the second substrate 105 may be attached to the magnetic body 110 by an adhesive sheet 106. For example, the first substrate 104 and the second substrate 105 may each respectively be attached to a separate adhesive sheet 106. The adhesive sheet 106 may be formed by an adhesive tape, and may be formed as an adhesive or a resin having adhesive properties is applied to a surface of the first substrate 104 and the second substrate 105 or the magnetic body 110.

In an example, the coil portion 120 is used by forming a coil pattern on a thin film substrate, without using a coil in the form of a wire, according to the related art, so a thickness of a thin film coil may be significantly reduced. However, a form of the coil portion 120 may be differently employed as required, and the form of a wire according to the related art may not be excluded.

A conductive via 103 allows the first wiring portion 101 and the second wiring portion 102 to be connected to each other to form a coil in the form of a solenoid surrounding the magnetic body 110 with the first wiring portion 101 and the second wiring portion 102.

As illustrated in FIG. 5, a single conductive pattern on the first substrate 104 and a single conductive pattern on the second substrate 105 are connected through two conductive vias 103, so disconnection between conductive patterns may be prevented.

In addition, the wireless communication antenna 100 may include a resin layer 107, and the resin layer 107 may be formed of a thermosetting resin having insulating and adhesive properties. The resin layer 107 may be disposed between the first substrate 104 and the second substrate 105, at an outer edge of the magnetic body 110. The resin layer 107 supports the first substrate 104 and the second substrate 105 in a space around the magnetic body 110, thereby preventing a defect such as disconnection occurring during a process, bubble inflow, or the like. In addition, the conductive via 103 passes through the resin layer 107 to be formed. In addition, although not illustrated in FIG. 5, a wireless communication antenna may include a cover layer. The cover layer may be disposed in or on the first wiring portion 101 and the second wiring portion 102, thereby serving to protect the first wiring portion 101 and the second wiring portion 102 at an outermost portion of a wireless communication antenna.

As described above, in an example, the magnetic body 110 is divided into the plurality of pieces 111, and the plurality of pieces 111 are arranged side by side in a direction (a horizontal direction based on FIG. 4) perpendicular to a direction of magnetic flux. In this case, the plurality of pieces 111 may have a form in which the pieces 111 are stacked on each other and a piece of a magnetic body is obtained by physically separating a single magnetic body or is separately manufactured. Here, the piece of a magnetic body which is separately manufactured may have a form of a sheet-shaped magnetic layer. In an example, as the magnetic body 110, a form in which the plurality of pieces 111 having been divided are arranged side by side is used rather than a single bulk form. In this regard, noise generation caused by a change in a volume of the magnetic body 110 may be significantly reduced when the wireless communication antenna 100 is driven, which will be described with reference to FIGS. 6 and 7.

Figure 6:
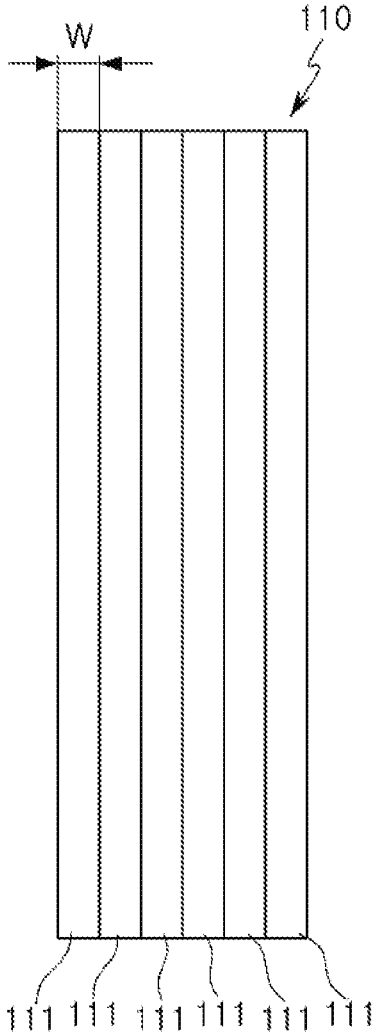
FIGS. 6 and 7 are plan views illustrating a form of a magnetic body of the wireless communication antenna of the example of FIG. 4.
Figure 7:
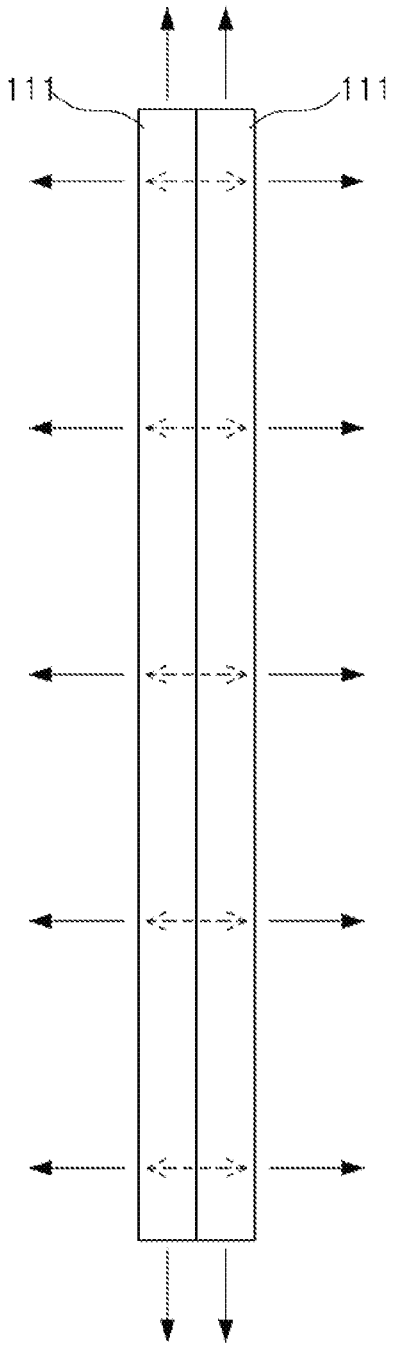

FIGS. 6 and 7 are plan views illustrating a form of a magnetic body in the wireless communication antenna of the example of FIG. 4. The plurality of pieces 111 are arranged in a direction perpendicular to a direction of magnetic flux, that is, in a width (w) direction, and each of the plurality of pieces has a rod shape extended in a direction parallel to a direction of magnetic flux.

As a form illustrated in FIG. 7, in the magnetic body 110 including the plurality of pieces 111 formed of a magnetic material, a volume thereof is changed due to an induced magnetic field generated when an electric field is applied. However, as indicated by a dotted arrow in FIG. 7, due to a different piece 111 adjacent thereto, a change in a volume in a lateral direction may be mitigated. Thus, compared to a case in which the magnetic body 110 is not divided, in the form in which a magnetic body is divided into the plurality of pieces 111, a change in a volume in a lateral direction may be significantly reduced. Thus, a change in a volume of the magnetic body 110 and noise generation thereby may be reduced. However, as the number of pieces 111 forming the magnetic body 110 increases, magnetic permeability may be reduced. Thus, it is required to properly adjust a size and the number of the pieces 111. Considering this, a width (w) of each piece 111 may be in a range of about 0.5 mm to 5 mm. In addition, in an example in which a magnetic body is divided into the plurality of pieces 111 and a change in a volume is reduced, the magnetic body 110 is formed of a material having a relatively significant magnetostriction coefficient, for example, a material with a magnetostriction coefficient of 5 or more. Thus, when a change in a volume due to an induced magnetic field is great, the example may be effectively applied.

Figure 8:
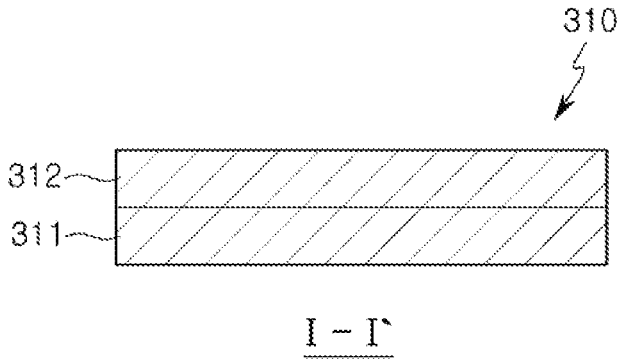
FIGS. 8 through 10 illustrate a form of a magnetic body employed in another example.
Figure 9:
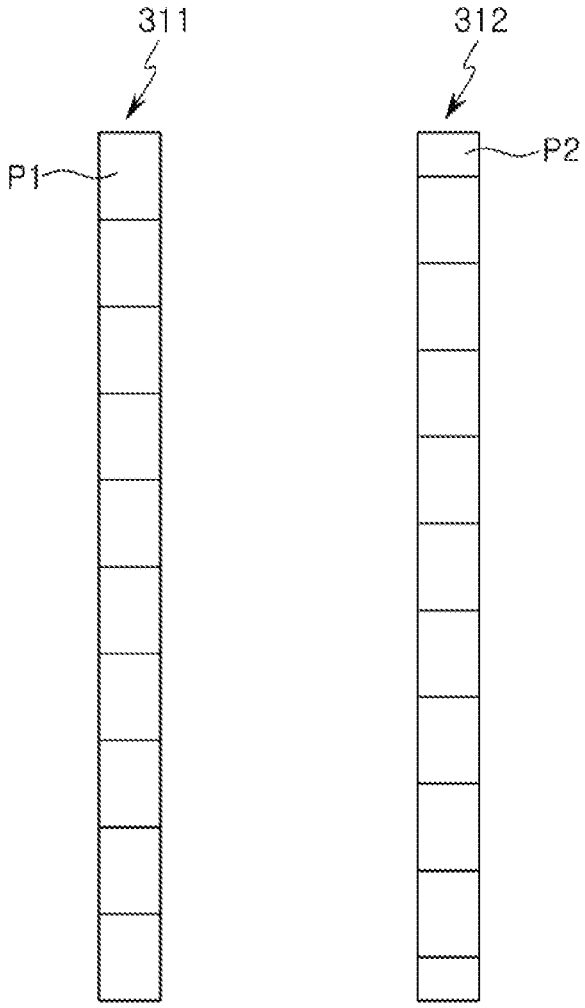
Figure 10:
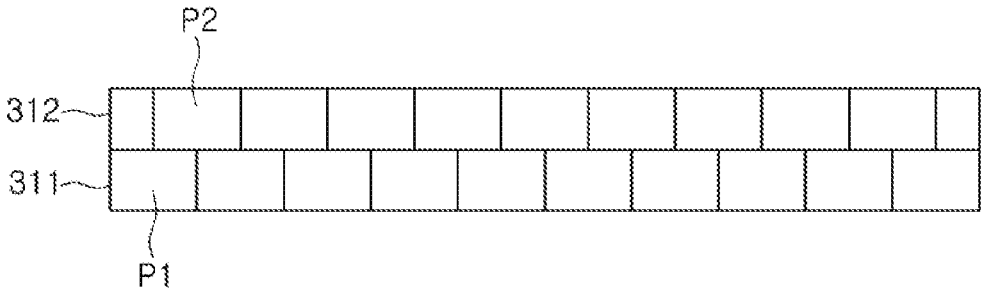

FIGS. 8 through 10 illustrate a form of a magnetic body employed in another example, FIG. 8 is a partial cross-sectional view taken along line I-I' showing the magnetic body, FIG. 9 is a plan view, and FIG. 10 is a partial cross-sectional view taken along line X-X' showing the magnetic body. In an example, as the form illustrated in FIG. 8, a magnetic body 310 has a structure in which a plurality of magnetic layers 311 and 312 are stacked on each other. An interface between the magnetic layers 311 and 312 is, e.g., a discontinuous surface. In addition, as the form illustrated in FIGS. 9 and 10, each of the plurality of magnetic layers 311 and 312 are divided into a plurality of pieces P1 and P2, respectively, and the plurality of pieces P1 and P2 are arranged side by side in a direction parallel to a direction of magnetic flux of a coil portion, that is, a vertical direction based on FIGS. 4 and 9. As the form according to an example, when a magnetic layer is divided into the plurality of pieces P1 and P2, a change in a volume of the magnetic body 310, generated in a vertical direction, may be reduced.

In addition, as the form illustrated in FIG. 10, the magnetic layers 311 and 312 have a form in which an interface between the plurality of pieces P1 and P2 do not overlap (that is, arranged to offset from) an interface in another magnetic layer adjacent thereto, in a stacking direction. When the plurality of pieces P1 and P2 are arranged to have a structure described above, magnetic flux may be effectively propagated through the plurality of pieces P1 and P2 in the magnetic layers 311 and 312 adjacent to each other. In other words, due to an interface between the plurality of pieces P1 and P2, that is, a discontinuous surface, interference of propagation of magnetic flux may be reduced. Thus, due to a stacking structure of the magnetic layers 311 and 312 as illustrated in an example, while a change in a volume of the magnetic body 310 is reduced, reduction of permeability may be significantly reduced.

As set forth above, according to examples, in the case of a wireless communication antenna, an effect due to a change in a volume of a magnetic body is significantly reduced, so noise generation may be reduced. Thus, a performance of a mobile device employing a wireless communication antenna may be improved. Further, according to examples, the division of the magnetic body 110 into either one or both of the pieces 111 and the pieces P1 and P2 provides an improved magnetic shape anisotropy to the magnetic body 110.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A wireless communication antenna, comprising:

a solenoid coil portion comprising a core;

a magnetic body serving as the core, the magnetic body including a plurality of magnetic layers stacked in a direction perpendicular to or a direction parallel to a direction of a magnetic flux of the solenoid coil portion;

the plurality of magnetic layers including a first magnetic layer having a plurality of first magnetic pieces and first interfaces formed between respective adjacent ones of the plurality of first magnetic pieces; and the plurality of magnetic layers including a second magnetic layer having a plurality of second magnetic pieces and second interfaces formed between adjacent ones of the plurality of second magnetic pieces, the second magnetic layer stacked on the first magnetic layer, the first interfaces not aligning with the second interfaces.

2. The wireless communication antenna of claim 1, wherein the magnetic layers are stacked in the direction perpendicular to the direction of the magnetic flux of the solenoid coil portion, and each of the magnetic lavers has a rod shape extended in the direction parallel to the direction of the magnetic flux.

3. The wireless communication antenna of claim 2, wherein a width of each of the magnetic lavers is 0.5 mm to 5 mm.

4. The wireless communication antenna of claim 1, wherein the magnetic layers are stacked in the direction parallel to the direction of the magnetic flux of the solenoid coil portion.

5. The wireless communications antenna of claim 1, wherein the magnetic layers are stacked in another direction perpendicular to the direction of the magnetic flux of the solenoid coil portion.

6. The wireless communication antenna of claim 1, wherein both the first magnetic pieces and the second magnetic pieces are arranged in the direction parallel to the direction of the magnetic flux of the solenoid coil portion.

7. The wireless communication antenna of claim 1, wherein a magnetostriction coefficient of the magnetic body is 5 or more.

8. The wireless communication antenna of claim 1, wherein the solenoid coil portion comprises a first wiring portion on a first surface of the magnetic body, a second wiring portion on a second surface of the magnetic body, and conductive vias are configured to connect the first wiring portion to the second wiring portion.

9. The wireless communication antenna of claim 8, wherein each of the first wiring portion and the second wiring portion comprises a conductive pattern on a thin film substrate.

10. The wireless communication antenna of claim 8, further comprising:

a resin layer at an outer edge of the magnetic body, wherein the conductive vias pass through the resin layer.

* * * * *